United States Patent [19]

Vogt

[11] Patent Number: 4,742,335

[45] Date of Patent: May 3, 1988

[54] SEQUENTIAL AND/OR RANDOM POLLING SYSTEM WITH VIRTUALLY INSTANTANEOUS RESPONSE TIME

[75] Inventor: William R. Vogt, Rockaway, N.J.

[73] Assignee: Baker Industries, Inc., Parsippany, N.J.

[21] Appl. No.: 875,821

[22] Filed: Jun. 18, 1986

[51] Int. Cl.[4] ..... G08B 26/00; G08B 5/00

[52] U.S. Cl. ..... 340/518; 340/505; 340/825.06; 340/825.08

[58] Field of Search ..... 340/518, 505, 825.06–825.13, 340/825.54, 825.5, 825.51, 506, 536

[56] References Cited

U.S. PATENT DOCUMENTS 4,356,475 10/1982 Neumann et al. ..... 340/825.06
4,361,832 11/1982 Cole ..... 340/518
4,367,458 1/1983 Hackett ..... 340/505

*Primary Examiner*—Donnie L. Crosland

*Attorney, Agent, or Firm*—James J. Jennings

[57] ABSTRACT

A communication system in which a controller ordinarily polls addressable transponders in a sequential or random manner normally allows the transponders to respond only in their respective assigned time period. Certain of the transponders are connected to allow response in a predefined time segment from those transponders so connected if (1) the transponder is in fact programmed for response during this predefined time segment, and (2) the predefined time segment is now occuring. By providing the predefined time segment at the same position in the response time period of each transponder, a "public time" is provided to allow virtually instantaneous identification and verification of a high priority interrupt (such as a holdup alarm). In addition the transponders programmed to respond during public time on a high priority basis can be subdivided into separate groups, and the groups can be identified at the controller.

22 Claims, 4 Drawing Sheets

84179-BKR
SHEET 1 OF 4

FIG. 4A
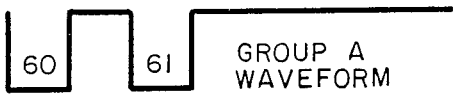
FIG. 4B
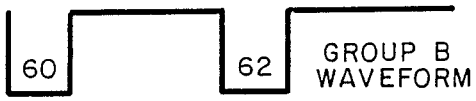
FIG. 4C
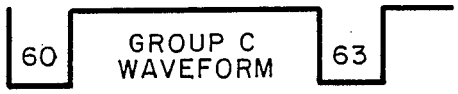
FIG. 4D
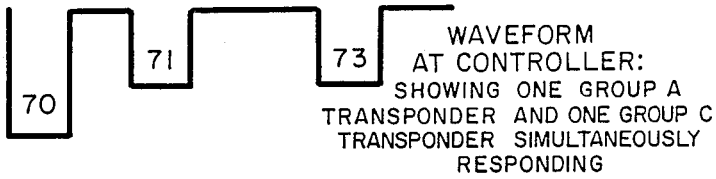
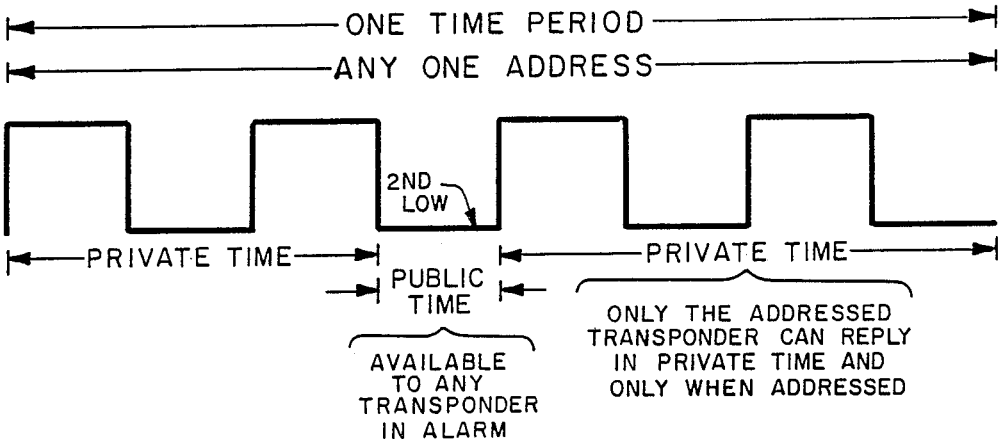
FIG. 6

SEQUENTIAL AND/OR RANDOM POLLING SYSTEM WITH VIRTUALLY INSTANTANEOUS RESPONSE TIME

FIELD OF THE INVENTION

The present invention is particularly directed to a polling system in which a controller communicates with two or more transponders, which transponders have different addresses. More particularly the invention is directed to a communication system emloying a unique polling arrangement by which the various transponders can reply virtually instantaneously to a high priority response, even when they have not been addressed and enabled for response by a normal transmission from the controller.

BACKGROUND OF THE INVENTION

Various types of polling techniques have been developed in the communication art. A controller can be connected over a single communication path (such as a pair of conductors) to a plurality of transponders, so that when any transponder goes into alarm the controller "knows" that some alarm condition has occurred, but does not know where the alarm event has taken place or which transponder is replying. An improvement over that system is an arrangement in which each transponder or passive alarm unit transmits a combination of an alarm signal with an identification of its location (its "address"). This can be accomplished without any polling signal from the controller, but it has a substantial drawback in that the controller does not recognize when one of the transponders becomes inoperative before it is required to transmit an alarm signal. For this reason improved systems have been developed in which the individual transponder units all have their individual respective addresses, which differ from each other, and the various alarm or transponder units can reply to the controller when addressed. In this way the controller knows when a transponder has a defect or trouble condition when it does not reply to a normal inquiry, even when no alarm or danger condition is present adjacent the addressed transponder.

In such polling arrangements, the transponders are frequently addressed in sequence. For example if there are 60 transponders connected over a single communication path to a controller, the first transponder is addressed and given time to reply, the second is then addressed, and so forth through the entire 60 units. In this way the controller is continually checking on the operability as well as the alarm status of each of the units. Another way to address the transponders is by generating the addresses in a random, rather than a sequential, manner.

A complete teaching of effective sequential polling arrangements is set out in U.S. Pat. Nos. 4,394,655, issued July 19, 1983; 4,470,047, issued Sept. 4, 1984; and 4,507,652, issued Mar. 26, 1985. All these patents are entitled "Bidirectional, Interactive Fire Detection System", and all are assigned to the assignee of this invention. In addition a technique for utilizing such polling systems to expand the amount and/or significance of the data transferred is described and claimed in application Ser. No. 716,799, filed Mar. 27, 1985, which issued Apr. 14, 1987 as U.S. Pat. No. 4,658,249 and is assigned to the assignee of this invention. The disclosures of these teachings, including the bidirectional and interactive features, are incorporated herein by reference.

With either polling technique (sequential or random) a finite time period, even though only a few seconds, is required to complete one polling sequence. This is a severe penalty when one or more of the alarm units are connected to transmit high-priority alarm information, such as "holdup in progress". For example if the 17th transponder out of 60 is connected to transmit the "holdup" signal and the 18th transponder is being polled when the holdup signal is initiated at transponder number 17, then the polling sequence must be completed and restarted, going back to number 17 before the holdup condition is recognized. If an actual bank robbery were in progress, this is an unacceptable delay.

It is thus a primary consideration of the present invention to provide a communication system of either the sequential or random polling type, in which the normal polling sequence is overridden when a high priority message is initiated at a given station.

A corollary consideration of the present invention is to provide such an improved system in which one or more subsets or small groups of transponders, within a larger group of transponders, can be connected for the high-priority interrupt operation, without necessitating such operation of all the transponders in the system.

Another important consideration of the present invention is to substantially eliminate the delay otherwise attendant upon the high-priority interrupt system, so that the alarm equipment such as surveillance cameras can be energized and in operation within a second after the high-priority alarm is initiated.

SUMMARY OF THE INVENTION

The present invention includes a communication system in which a controller is coupled over a communication path with two or more transponders. The communication path can be a pair of electrical conductors, an optical fiber conductor, coaxial cable, air, or any other path. At least two of the transponders have different addresses. The controller and transponders communicate using a polling technique which incorporates time periods to allow communication between the controller and the selected, or addressed, transponder.

In accordance with the present invention, means (including the controller) is provided to define at least one predefined time segment, which occurs at a predetermined time in a poll. The time segment may occur at or within the address time ("time period") of a given transponder, or at a time interval between the addresses or response times of two transponders, or at a time after all the transponders have been addressed and given an opportunity to reply before the next round of polling. During the predefined time segment one or more transponders, from one or more specified groups, can simultaneously reply to the controller.

One analogy which may be helpful to understanding the broad concept of the invention is to consider the various transponders as individual telephone subscribers along a common or party telephone line. Each of the subscribers has his or her own given telephone number, or "address". With a group of 12 subscribers, each may be given a different five-minute segment of the hour during which he can respond when his telephone substation is addressed from the central station. However in the event there is a high priority message, there is a predefined time segment, or "public" time, within each five minute period during which any of the subscribers can respond, notwithstanding it is not his assigned time period. Of course the time durations in actual polling of security and/or fire detection systems are much shorter, with individual times being measured in milliseconds and a complete round of polling completed in only a few seconds.

THE DRAWINGS

In the several figures of the drawings, like reference numerals identify like components, and in those drawings:

FIGS. 4A–4D are graphical illustrations useful in understanding operation of the invention;

FIG. 6 is a graphical illustration useful in conjunction with the other figures in understanding the operation of the invention.

DETAILED DESCRIPTION OF THE INVENTION

Figure 1:
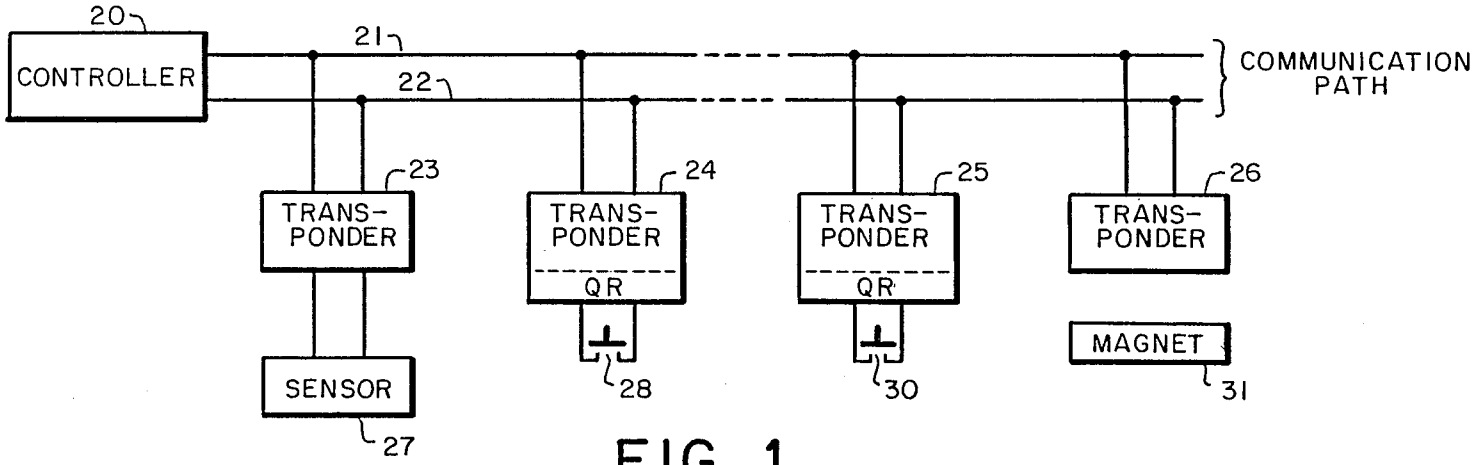
FIG. 1 is a block diagram useful in understanding a general polling system layout.

FIG. 1 depicts a general system arrangement in which a controller 20 is coupled over a communication path 21, 22 to a plurality of transponders 23, 24, 25 and 26. The communication path can be a conventional pair of electrically conductive wires or cables, or can be an optical fiber cable, a coaxial cable, a portion of the airwaves for transmission between a pair of transceivers or any other suitable communication path. Transponder 23 is coupled to a sensor 27, which can be any conventional type of sensor such as a temperature sensor, a water flow sensor, an infrared sensor, or any desirable unit.

Transponder 24 includes a special circuit designated QR, and also a push-type switch 28 coupled to the circuit QR. Tranponder 25 has a similar special circuit QR, and another switch 30 coupled to its respective QR circuit. Transponder 26 has a magnet 31 positioned adjacent this transponder. This transponder could be, by way of example, a transponder of the type designated 60 in FIG. 4 of the patent application entitled "Unitary Alarm Sensor and Communication Package for Security Alarm System", Ser. No. 832,624, filed Feb. 25, 1986 and assigned to the assignee of this invention. The circuitry of the other transponders will be readily understandable from the disclosures in the above-identified patents and the previously identified application having Ser. No. 716,799 now U.S. Pat. No. 4,658,249.

The switches 28 and 30 are shown to provide a simplified indication of how the high-priority data might be inserted into an otherwise conventional polling arrangement. By way of example in a security system for a bank or other financial institution, the switches 28, 30 might be designated "holdup" switches and positioned in the tellers' workspaces for surreptitious actuation during a holdup situation. In such a situation it is requisite that the alarm be transmitted to energize surveillance cameras to record images on high speed film, and this must be done rapidly so that the opportunity for identification is not lost. Accordingly it is manifest that the transponder having its associated holdup switch pushed cannot simply wait for its next turn in the polling sequence.

Figure 2:
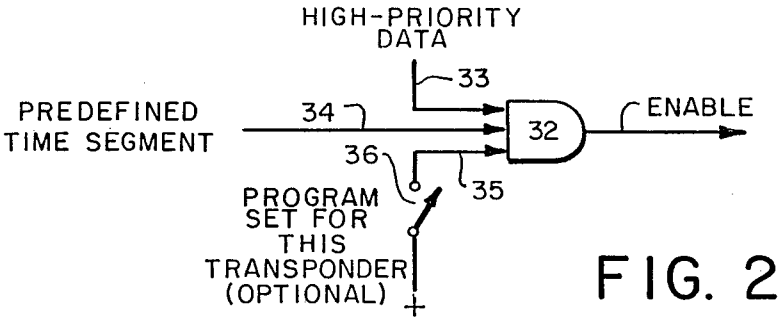
FIG. 2 is a simplified logic diagram useful in understanding a basic principle of the present invention.

FIG. 2 shows in simplified form how the holdup switch or other high-priority interrupt is used to enable a transponder to respond out of sequence. An AND circuit 32 is provided to receive the high-priority data signal from a switch such as 28, or other such interrupt signal, over line 33. When the "public time" or predefined time segment occurs, another signal is provided over line 34 to the AND circuit. Another signal is provided over line 35 to the AND circuit when switch 36 is closed, indicating that this particular transponder has its special circuit QR energized so that the high-priority interrupt will be fed through the transponder at the next public, or common, response time in the poll. Those skilled in the art will appreciate that a switch 36 is not required, but it is only the coincidence of the predefined time segment and the high priority interrupt signal to provide the enable signal that is necessary to produced the desired operation. Switch 36 provides a convenient way for inserting a certain transponder into, or removing a transponder from, a holdup alarm loop. Closure of switch 36 in effect selects the option of high-priority interrupt, and thus the signal on line 35 is an "option bit" which is utilized in the AND circuit 32. If it is later decided to remove the specific transponder from the holdup (high-priority interrupt) circuit, then switch 36 is opened. Of course the switch 36 is a convenience feature and not a necessity. Rather than having the entire transponder pre-wired for either priority interrupt or conventional operation, use of a switch (such as 36) allows a given transponder to be simply and rapidly inserted into, or removed from, the logical instant alarm circuit.

The transponders connected in the holdup circuit—whether by switches, two wires or other means—together comprise a logical sub-loop or subset within the system loop (all the units interooupled over communication path 21, 22). Use of switches (such as 36) makes it simple to insert transponders in, and remove transponders from, the logically designated sub-group; in all such insertions and removals, the transponders always remain coupled to the controller and always reply in the usual manner.

Figure 3:
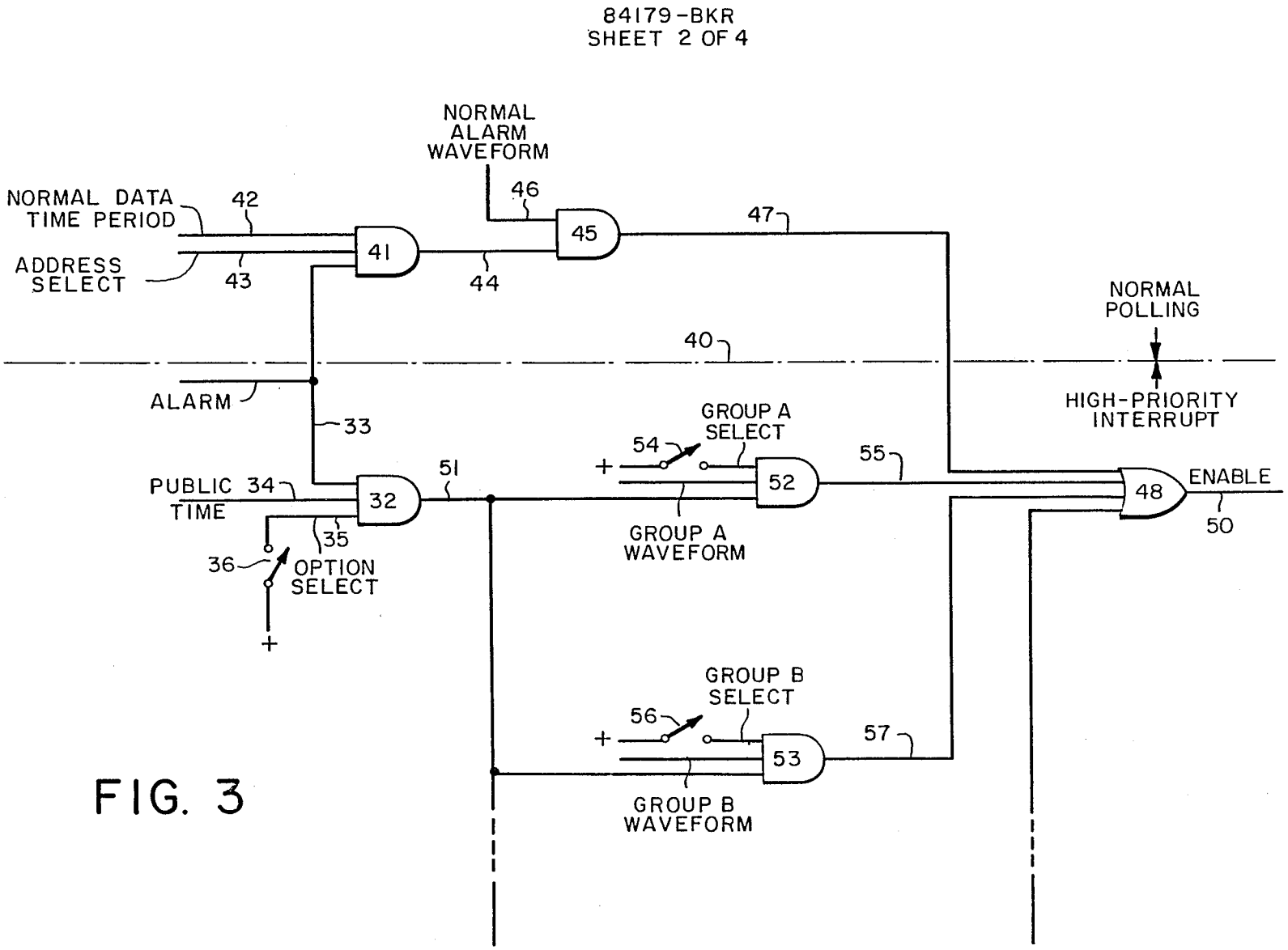
FIG. 3 is a logic diagram depicting the signal flow of an embodiment of the present invention.

FIG. 3 shows the logic arrangement for a preferred embodiment of the present invention. Above the dash-dot line 40 the circuitry is that used in conventional, sequential polling (as taught, for example, in the above-identified patents), and below the line is the logic arrangement which has been added to implement the present invention.

Above the line a first AND circuit 41 receives a first input signal over line 42 denoting that the system is in the time period in which data can normally be transmitted, and the signal received over line 43 indicates that the address of this particular transponder has been selected. Alarm or high priority data is present on line 33. When all three inputs are present to AND circuit 41, an output signal is provided over line 44 to another AND circuit 45; the usual alarm waveform is present on line 46 to this AND circuit. Thus when the signals on lines 44 and 46 are both present, AND circuit 45 provides an output signal over line 47 to one input of an OR gate 48. Under these conditions the alarm signal on line 47 is passed through OR gate 48 to provide an enable output signal on line 50.

The circuitry of the present invention below line 40 includes AND gate 32, already described in connection with FIG. 2. The high-priority data in FIG. 2 is represented as the alarm signal on line 33 in FIG. 3. The predefined time segment is denoted as "public time", the signal on line 34. The option select switch 36 remains the same. Thus the output from AND circuit 32 is provided on line 51, and this could be the "enable" signal if so desired.

However in accordance with another feature of the invention, this output signal from AND circuit 32, indicating that a holdup or high priority alarm situation has occurred, is also provided to additional AND circuits 52 and 53. Suppose that a bank has a row of teller cages positioned in a first location. In a second location there may be another sequence of teller cages, or a location where foreign currency is traded or other cash is readily available. Assume that each transponder adjacent the teller positions has its option select switch 36 closed, and it is desired to have indicated at the controller that a teller station is forwarding the holdup alarm. The teller stations can then all be assigned to group A, and the group A select switch 54 is closed to provide an indication to AND circuit 52 that the signal received over line 51 is to be designated in the group A lineup of positions. This is accomplished by providing a group A waveform, as depicted in FIG. 4A, on the second input line to AND circuit 52. Thus AND circuit 52 is enabled to provide on its output line 55 a signal indicating both that a holdup alarm signal has been initiated, and that such signal has originated in the group designated A.

If a group of vault locations or other high-priority locations are arbitrarily assigned to group B, then a group select switch such as 56 is closed for each such station assigned in this second group. Then when the alarm or interrupt signal appears on line 51, if the group B select switch 56 is also closed, the output from AND circuit 53 on line 57 is a signal such as that depicted in FIG. 4B, which is different from that shown as the group A waveform. Any number of additional group select arrangements can be made, all providing signals over their respective outputs to OR circuit 48 as illustrated.

In the waveform sequence, the group waveforms depicted in FIGS. 4A, 4B and 4C each have an initial, common reference portion 60. The group A waveform also has a negative pulse 61 at a predetermined time after the reference pulse. The group B waveform has a negative pulse 62 at a later time, and at a still later time the group C waveform has a pulse 63.

At the controller the waveform shown in FIG. 4D indicates to the equipment that the reference pulse has been received, as represented by the negative pulse 70. In addition a pulse 71 has been received, denoting that an alarm signal has been generated in the A group. Receipt of pulse 73 indicates a high-priority interrupt has also been generated in group C. Thus the controller is able to distinguish not only that a holdup alarm has been initiated, to provide a high priority interrupt, but also can identify the particular group or groups in which the holdup alarm has been produced. This adds a great deal of flexibility and identification value to the system of the invention.

Figure 5:
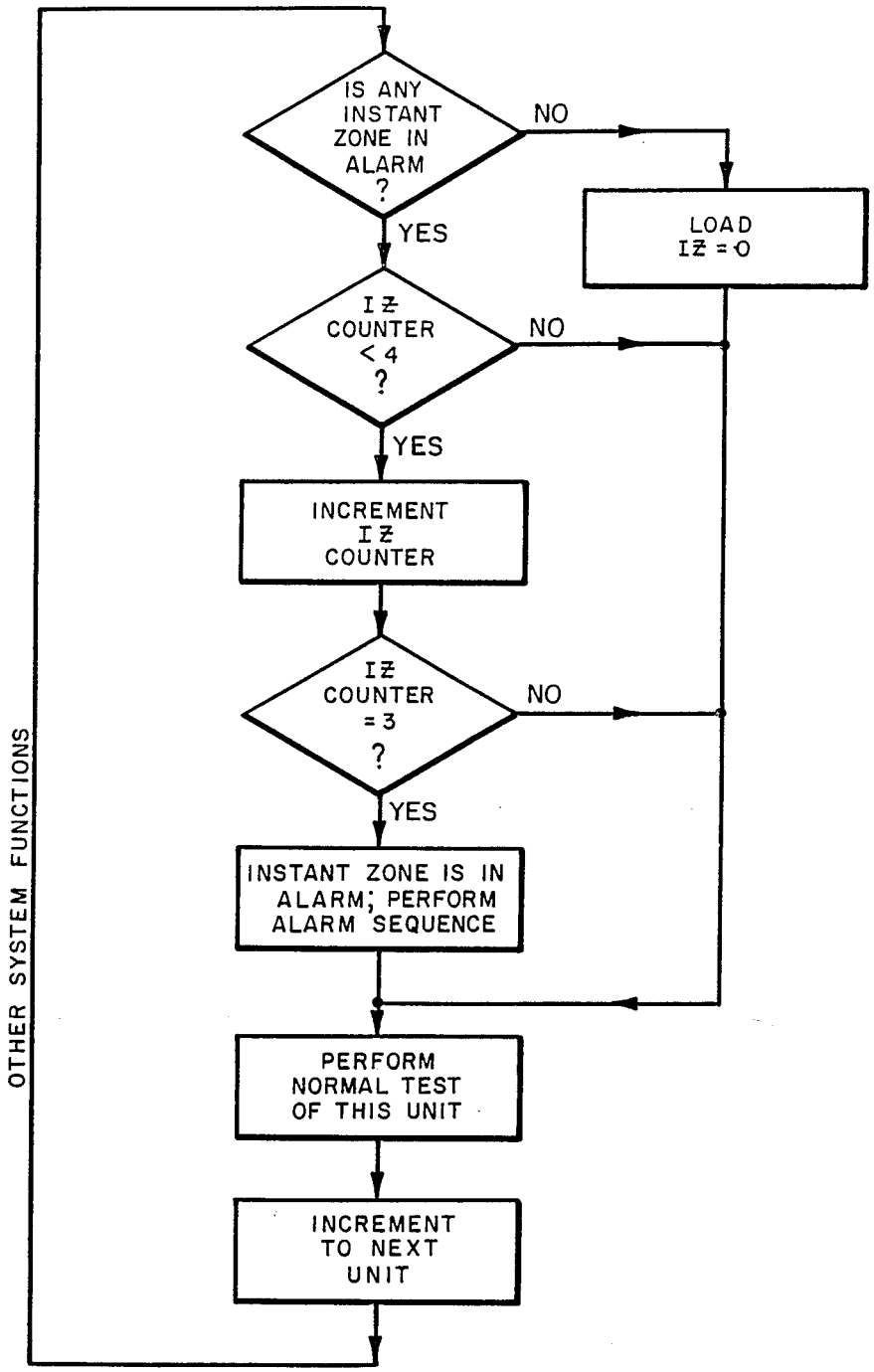
FIG. 5 is a flow chart useful in understanding the operation of the present invention.

FIG. 5 depicts in flow chart arrangement the sequence of operation of a polling system with the high-priority interrupt. In the illustration of FIG. 5, the high-priority or alarm signal is termed the "Instant Zone", because the total system response time is within less than one second, which can be considered instantaneous for practical purposes. The system response may include actuation of individual relays (to turn on cameras, for example). In the preferred embodiment the controller normally "sees" the first response in about a twentieth of a second; this is verified by two more responses. Thus the total time to detect and confirm the high-priority alarm condition is only about three-twentieths of a second. When the system enters the instant zone loop at the top of the chart (FIG. 5), the first decision is whether any instant zone transponder is then in alarm. If no such alarm has been issued, the instant zone counter is loaded with the value zero, and the normal test routine of whatever device has been addressed is performed. The system is then incremented to the next normally-addressed unit, and other system functions are performed, such as turning on relays, checking the position of already-actuated units, and so forth. The normal functions have been described in the above-referenced patents and applications.

If the instant zone is in alarm, then the system checks to determine whether the instant zone counter total is less than 4. If not, the normal test is again performed and the system incremented. If the instant zone counter total is less than 4, then the counter is incremented and another determination is made, to see whether the instant zone counter total has yet reached 3. If not the normal test functions are performed and the loop reentered. If however the instant zone counter has accumulated to 3, this confirms that at least one of the instant zone transponders is indeed in alarm, and the alarm sequence is then performed. The reason that the total of 3 is accumulated is to provide a double confirmation that there is in fact a holdup or other high priority interrupt in effect at this time. Even with the original instant zone signal, and the two subsequent confirmations, that entire sequence, and performance of the alarm sequence (such as multiple relay activation), is accomplished in less than one second. This is adequate time to activate the high-speed surveillance cameras and associated units in such an emergency situation.

In performing the alarm sequence in a preferred embodiment, after the two confirmations of the original instant zone signal, the system of the invention terminates the conventional poll. It immediately goes to an abbreviated poll of only those transponders which are instant zone output units, such as those units having relays for energizing to turn on high-speed cameras. Thus if there are five instant zone output devices (such as relays, led's, etc.) selected, these can be set with addresses 1 through 5 in sequence. The address is set by electrical switches in each transponder, and thus does not necessarily relate to the physical placement of a unit within any given area. The controller then simply polls the transponder units 1 through 5 which regulate the selected output devices. Then this poll of transponders 1–5 is repeated, since in the preferred embodiment requests for actuation of output devices must be confirmed before any actuation will be performed. The total elapsed time, from holdup switch operation to actuation of all five relays, is normally about one-half second.

Note that after this "insta-poll"—a shortened poll of only the preselected addresses (such as 1–5) desired for output control—is completed, the system again begins polling normally. The specific address of the transponder(s) originating the alarm will be identified as "in alarm", in a manner taught in the patents identified above, and this identification will only be delayed by approximately one-half second (in the performance of the "insta-poll").

FIG. 6 shows one sequence of high and low pulse portions of a complete pulse sequence at a given address. For example in U.S. Pat. No. 4,470,047, FIG. 4 shows the sequences of 4-high and 4-low pulses in each transponder grouping, or time period. FIG. 6 of this application shows four high and low pulses at one transponder address. As is the case with the teaching of the patents referenced above, the time periods of all the high portions, and of the first, third and fourth low portions are "private time". That is, only the transponder at this particular address can interact with the controller during these portions of the transponder time period. In accordance with the present invention, in the preferred embodiment the second low is converted from a previous use and is now defined as "public time". This public or common time represents a predefined time segment which occurs at a predetermined time in a poll. In the preferred embodiment it occurs at the same time interval within every transponder time period. It will be apparent to those skilled in the art that the predefined time segment, or public time, could also be interposed between each address, or at more than one time segment in each address, so that the response would be virtually as fast. However in the preferred embodiment this second low has been converted from a previous use, such as denoting the relay state in application Ser. No. 716,799, now U.S. Pat. No. 4,658,249 to provide the public time availability to any transponder then signifying a high-priority alarm, and programmed to respond in the public time, to come on the line and provide notice to the controller that a holdup or other dangerous emergency exists.

Technical Advantages

The present invention has all the advantages of addressable polling systems, particularly in recognizing when a trouble condition exists by the non-reply of an addressed transponder. In addition the invention provides a polling system with a virtually instantaneous response to any emergency situation, such as a holdup alarm. This is provided by affording a "public time" for response from any transponder, either within a predefined time segment of a given transponder address, or between adjacent addresses. Of course the predefined time segment could overlap addresses, such as occuring in the last segment of one address (or time period) and the initial segment of the following address.

Another important advantage provided by the invention is that, in effect, the grouping of the holdup alarms provides a zone (such as a "holdup zone") within a larger zone. In addition multiple zones can be defined so that different holdup zones are signalled to, and identified at, the controller, by using the group A select, group B select, and so forth, sequence described in connection with the circuit of FIG. 3. Tests have demonstrated that the response time with this public time incorporated within a specific address period of each transponder gives a response, including confirmation and taking the desired action (for example, turning on relays), in about one-half second. For these reasons the described system has been termed an "instant zone".

In the appended claims the term "connected" means a d-c connection between two components with virtually zero d-c resistance between those components. The term "coupled" indicates there is a functional relationship between two components, with a possible interposition of other elements or air between the two components described as "coupled" or "intercoupled".

While only a particular embodiment of the invention has been described and claimed herein, it is apparent that various modifications and alterations of the invention may be made. It is therefore the intention in the appended claims to cover all such modifications and alterations as may fall within the true spirit and scope of the invention.

What is claimed is:

1. A communication system in which a controller is coupled over a communication path with two or more transponders, at least two of which transponders have different addresses, which controller and transponders communicate by using a polling technique which incorporates time periods to allow communication between the controller and a selected transponder, and means, including the controller, for defining at least one preferred time segment which occurs at a predetermined time in a poll, during which time segment one or more transponders can simultaneously reply to the controller regardless of whether the transponders simultaneously have been specifically addressed by the controller.

2. A communication system as claimed in claim 1, in which said predefined time segment occurs within one or more of said time periods.

3. A communication system as claimed in claim 1, including means for assigning some of said transponders to a first group and others of said transponders to a second group, such that said first and second groups are separately identifiable while the transponders are simultaneously responding to the controller.

4. A communication system as claimed in claim 2, in which certain of said transponders include additional means operable to cause said certain transponders to include said predefined time segment within said certain transponders' time periods.

5. A communication system as claimed in claim 1, in which said predefined time segment occurs within each of said time periods.

6. A communication system as claimed in claim 5, in which said predefined time segment occurs at the same interval within each of said time periods.

7. A communication system in which a controller is coupled over a communication path with a plurality of transponders, at least some of which transponders have different addresses, which controller and transponders communicate by using a polling technique whch incorporates successive time periods, to allow communication between the controller and a selected transponder during one of said time periods, and means, including the controller, for defining at least one public time segment which occurs at a predetermined time in a poll, during which public time one or more transponders, from one or more specified groups, can simultaneously reply to the controller regardless of whether the transponders simultaneously replying have bee specifically addressed by the controller.

8. A communication system as claimed in claim 7, in which said public time occurs within one or more of said time periods.

9. A communication system as claimed in claim 7, including means for assigning some of said transponders to a first group and others of said transponders to a second group, such that said first and second groups are separately identifiable while the transponders are simultaneously responding to the controller in a public time segment.

10. A communication system as claimed in claim 8, in which said public time occurs at the same relative position within each of said time periods.

11. A communication system as claimed in claim 8, in which certain of said transponders include additional means operable to cause said certain transponders to include or not include said public time within said certain transponders' time periods, thus defining a group of transponders capable of responding in the public time.

12. A communication system as claimed in claim 11, in which said public time occurs at the same relative position within each of said time periods.

13. A communication system in which a controller is coupled over a communication path with a plurality of transponders, which transponders have different addresses, and in which the controller and transponders communicate by using a sequential polling technique which incorporates successive time periods to allow communication between the controller and successively selected transponders, and means, including the controller, for defining at least one public time segment which occurs at a predetermined time in a poll, during which public time one or more transponders, from one or more specified groups, can simultaneously reply to the controller regardless of whether the transponders simultaneously replying have been specifically addressed by the controller.

14. A communication system as claimed in claim 13, in which said public time occurs at the same interval within each of said time periods.

15. A communication system as claimed in claim 13, including means for assigning some of said transponders to a first group and others of said transponders to a second group, such that said first and second groups are separately identifiable while the transponders are simultaneously responding to the controller in a public time segment.

16. A communication system as claimed in claim 14, in which certain of said transponders include option select means, operable to enable said certain transponders to respond or not respond during said public time within said certain transponders' time periods, but to respond only if a high-priority alarm is present at one of said certain transponders.

17. A communication system as claimed in claim 16, in which a first group of said certain transponders also includes group select means, operable to identify to the controller that any of said first group transponders replying during said public time are in fact connected in said first group.

18. A communication system as claimed in claim 17, in which a second group of said transponders, which is different from said first group, also includes group select means, operable to identify to the controller that any of said second group transponders replying during said public time are in fact connected in said second group.

19. The method of polling a plurality of addressable transponders in a regular manner to effect bidirectional data transmission, in which certain of said transponders include means for effecting a high-priority interrupt which differs from the usual data transmission, including the steps of:

regularly polling the transponders to effect usual data transmission, in which each successive transponder communicates with the controller during a predetermined time period;

allocating, for certain of said transponders, a predefined time segment in the time period of each of said certain transponders during which a high-priority interrupt can be transmitted to the controller even though that particular transponder has not been addressed; and identifying to the controller that a high-priority interrupt signal has been transmitted from one of said certain transponders.

20. The method of claim 19, comprising the further step of continuing the regular polling for a predetermined number of time periods, to confirm initiation of the high-priority interrupt by at least one of said certain transponders.

21. The method of claim 20, and including, after said predetermined number of time periods and confirmation of the high-priority interrupt, the additional steps of:

terminating the regular polling of all transponders; and initiating a poll of only said certain transponders, to effect a predetermined action subsequent to confirmation of the high-priority interrupt.

22. The method of claim 21, and including, after completion of the poll of only said certain transponders, the additional step of:

returning to the method of polling the transponders in a regular manner.

* * * * *